US012110170B2

(12) United States Patent
Janak

(10) Patent No.: US 12,110,170 B2
(45) Date of Patent: Oct. 8, 2024

(54) SHOE BOX

(71) Applicant: Boot Royalty Company, L.P., Fort Worth, TX (US)

(72) Inventor: Terri Janak, Fort Worth, TX (US)

(73) Assignee: Boot Royalty Company, L.P., Fort Worth, TX (US)

( * ) Notice: Subject to any disclaimer, the term of this patent is extended or adjusted under 35 U.S.C. 154(b) by 350 days.

(21) Appl. No.: 16/711,660

(22) Filed: Dec. 12, 2019

(65) Prior Publication Data

US 2020/0198878 A1 Jun. 25, 2020

Related U.S. Application Data

(60) Provisional application No. 62/783,276, filed on Dec. 21, 2018.

(51) Int. Cl.
*B65D 85/18* (2006.01)
*B65D 5/498* (2006.01)

(52) U.S. Cl.
CPC ..... *B65D 85/187* (2013.01); *B65D 5/48048* (2013.01)

(58) Field of Classification Search
CPC .. B65D 85/187; B65D 5/48048; B65D 85/18; B65D 5/4266; B65D 5/46024; B65D 25/04; B65D 25/54; B65D 5/4204; B65D 25/10; B65D 25/102; B65D 25/06; B65D 5/48024; B65D 5/5021; B65D 5/0254; B65D 5/22; B65D 5/5213; B65D 5/38; B65D 5/4237; B65D 5/4295
USPC ..... 206/278, 299, 561, 167, 292, 297, 425, 206/213, 214; 220/529, 549, 550, 533, 220/551; 211/184, 38
See application file for complete search history.

(56) References Cited

U.S. PATENT DOCUMENTS 300,724 A * 6/1884 Nauerth ..... A47B 88/48 40/325
464,544 A * 12/1891 Wood ..... B65D 25/04 220/532
672,686 A * 4/1901 Styles ..... B42F 17/02 220/550
1,677,544 A * 7/1928 Gourley ..... A47B 88/90 211/184
1,896,761 A * 2/1933 Wheary ..... A45C 13/02 206/293

(Continued)

*Primary Examiner* — Steven A. Reynolds
*Assistant Examiner* — Prince Pal
(74) *Attorney, Agent, or Firm* — IP Attorneys Group, LLC

(57) ABSTRACT

The present related to a shoe box that accommodates different shoe sizes and styles. In many embodiments the shoe box is provided with a protrusion which limits movement of items within the box. In some embodiments the protrusions are able to be placed in an extended or contracted position. In some embodiments there are a variety of extended positions which a protrusion could be placed in such that the size of the protrusion can be altered based on the size of the contents inside of the shoe box. In some embodiments the protrusion is attached to the shoe box and others it is removably attachable. In other embodiments the protrusion can shift within the shoe box such that the protrusion can be placed in the area which most needs it. This invention beneficially allows different sized items to be securely placed in the same shoe box.

14 Claims, 6 Drawing Sheets

(56) References Cited

U.S. PATENT DOCUMENTS 2,736,483 A * 2/1956 Moore ..... B65D 5/68 229/196
2,883,042 A * 4/1959 Richer ..... B65D 5/18 229/113
3,433,548 A * 3/1969 Moore ..... B42F 17/08 312/289
3,491,909 A * 1/1970 Ikelheimer ..... A45C 13/02 217/7
3,749,299 A * 7/1973 Ingle ..... B65D 5/18 229/178
4,552,272 A * 11/1985 Field ..... A47F 5/0846 248/222.51
4,795,029 A * 1/1989 Campbell ..... B65D 85/187 206/508
4,889,253 A * 12/1989 Schmulian ..... A45C 13/02 403/107
4,896,766 A * 1/1990 Paley ..... B65D 5/5213 206/754
4,955,469 A * 9/1990 Hudspith ..... B65D 5/4204 229/162.1
5,148,942 A * 9/1992 Snook ..... B65D 25/06 206/561
5,193,671 A * 3/1993 Patterson ..... B65D 5/5213 206/278
5,242,223 A * 9/1993 Koves ..... A47B 88/90 312/348.3
5,351,819 A * 10/1994 Varon ..... B65D 5/48024 206/534
5,819,922 A * 10/1998 Martin, Jr. ..... B42F 15/007 206/214
6,070,717 A * 6/2000 Philipson ..... A47F 3/14 220/241
6,951,277 B1 * 10/2005 Meynard ..... B65D 5/5021 190/13 F
7,163,118 B2 * 1/2007 Cheng ..... A47B 88/994 206/561
7,163,119 B2 * 1/2007 Besselman ..... A47B 96/04 220/551
9,182,168 B2 * 11/2015 Hernandez ..... F25D 25/025
2001/0002653 A1 * 6/2001 Ohno ..... B65D 5/4216 206/315.9
2004/0144789 A1 * 7/2004 Cheng ..... A47B 88/975 220/529
2004/0211822 A1 * 10/2004 Lin ..... B65D 5/48018 206/299
2004/0238543 A1 * 12/2004 Askew ..... B65D 81/3816 220/529
2005/0056688 A1 * 3/2005 Hsi-Ching ..... B65D 5/48024 229/162.1
2005/0082179 A1 * 4/2005 Terwelp ..... B65D 5/46024 206/278
2005/0218763 A1 * 10/2005 Bisson ..... A47B 88/90 312/348.1
2005/0258224 A1 * 11/2005 Meynard ..... B65D 5/5021 229/120.13
2006/0037824 A1 * 2/2006 Park ..... A45C 13/03 190/110
2007/0039840 A1 * 2/2007 Mu ..... B65D 5/4295 206/278
2007/0095720 A1 * 5/2007 Barnett, Jr. ..... B65D 25/06 206/581
2010/0314268 A1 * 12/2010 Goodman ..... B65D 5/721 206/281
2010/0314435 A1 * 12/2010 Goodman ..... B65D 5/4237 229/126
2011/0094907 A1 * 4/2011 Meynard ..... B65D 5/48024 229/120.08
2011/0155795 A1 * 6/2011 James ..... A61G 7/0524 220/500
2011/0174643 A1 * 7/2011 Pookrum ..... B65D 5/62 220/4.28
2013/0270132 A1 * 10/2013 Meynard ..... B65D 85/18 206/299
2013/0270133 A1 * 10/2013 Kenner ..... B65D 5/4266 206/320
2014/0251843 A1 * 9/2014 Goligorsky ..... B65D 77/0406 206/297
2015/0189964 A1 * 7/2015 Gutierrez ..... B65D 85/187 206/292
2016/0229581 A1 * 8/2016 Smith ..... B65D 5/0005
2017/0001791 A1 * 1/2017 Schow ..... B65D 5/0254
2017/0202401 A1 * 7/2017 Mortell ..... B65D 81/386
2017/0305650 A1 * 10/2017 Coulter ..... B65D 5/4237
2018/0251257 A1 * 9/2018 Hasegawa ..... B65D 5/46024
2019/0055050 A1 * 2/2019 Phillips ..... B65D 5/48038
2019/0112094 A1 * 4/2019 Dwork ..... B65D 5/0254
2019/0119001 A1 * 4/2019 Berger ..... B65D 25/205
2019/0168908 A1 * 6/2019 Lee ..... B65D 5/5021
2022/0033132 A1 * 2/2022 Darmon ..... B65D 5/64

* cited by examiner

SHOE BOX

This application claims priority to and the benefit of U.S. Provisional Patent Application No. 62/783,276, filed Dec. 21, 2018 and titled "Shoe Box." The contents of the above-identified Application is relied upon and incorporated herein by reference in its entirety.

BACKGROUND OF THE INVENTION

The present invention relates to a shoe box that accommodates different shoe sizes and styles.

Typically shoe boxes are generally rectangular objects made of cardboard or other similar material with a lid. The lid is often either removable or attached, and the box itself empty. As shoes come in a variety of different styles, such as boots, sneakers, flats, and heels, different sized shoe boxes are often required for these various styles, with boots typically requiring longer boxes than sneaker or flats. The requirement of having different size shoe boxes often forces the shoe manufactures to produce and stock a variety of box sizes, and can cause issues with shoe retailers in regards to different box sizes fitting and looking aesthetically pleasing on different shelves around the store.

Even for the same style of shoe, the different shoe sizes often require different box sizes in order for the smallest and largest shoes to fit into the box with the same balance of protection and comfort. However, typically manufactures use a box size that fits either the largest or a series of larger shoes and pack the smaller shoes with excess paper or other packing materials to avoid the shoe from jostling too much during shipping. This method can waste packing materials and cause hassles for the customer who has to remove the materials to see or try on the shoe, and then replace the materials if the shoe does not fit, or if they do not want to purchase that particular shoe.

Thus, what is needed is a shoe box which can accommodate different shoe sizes and styles. Ideally this shoe box would have similar outer dimensions, but have an internal mechanism which modifies the area inside of the shoe box and allow it to encapsulate a variety of different shapes and sizes of shoes or other items. Such a shoe box would allow for easier manufacturing, shipping, storing, and selling of the shoes as only one or a small number of box types with generally consistent external dimensions could be used.

SUMMARY OF THE INVENTION

The present invention relates to a shoe box that accommodates different shoe sizes and styles. In some embodiments the shoe box comprises a base which defines an inner area, a lid which fits over the base, and at least one protrusion within the inner area. In some embodiments an insert is placed over the protrusion. In some embodiments the insert has a protrusion. In many embodiments the protrusion on either the base or the insert limits the movement of items within the shoe box.

In different embodiments the protrusion is secured to the inner area and protrudes into the inner area via different mechanisms. In some embodiments the protrusion can be placed in either an extended or contracted position. In some of these embodiments, the extending or contracting is facilitated by a fold line on the protrusion. In some of these embodiments the insert comprises a fold line to help it fit over the protrusion in both the extended and contracted position.

In some embodiments the protrusion is removably attachable. In some of these embodiments the protrusion is attached to the base by a tab on the protrusion which fits into a slit on the base. In other embodiments the protrusion fits into a pocket on the base. In other embodiments the base further comprises a track where a tab on the protrusion fits into and allows the protrusion to slide along the track. In some embodiments the track is also equipped with one or more slits which halt the movement along the track and lock the protrusion in a specific position.

In different embodiments the protrusion is located on different faces of the base. In some embodiments the protrusion is attached to only one face of the base and in others it is attached to multiple faces. In other embodiments multiple protrusions are provided which are on the same face and in other embodiments the multiple protrusions are on different faces.

In some embodiments the shoe box is further provided with a handle, in others the shoe box is further provided with a window, and in other the shoe box is further provided with a sleeve which fits around the shoe box. In some embodiments with a sleeve the sleeve fits over the lid and in others the sleeve replaces the lid.

DETAILED DESCRIPTION OF THE INVENTION

Figure 1:
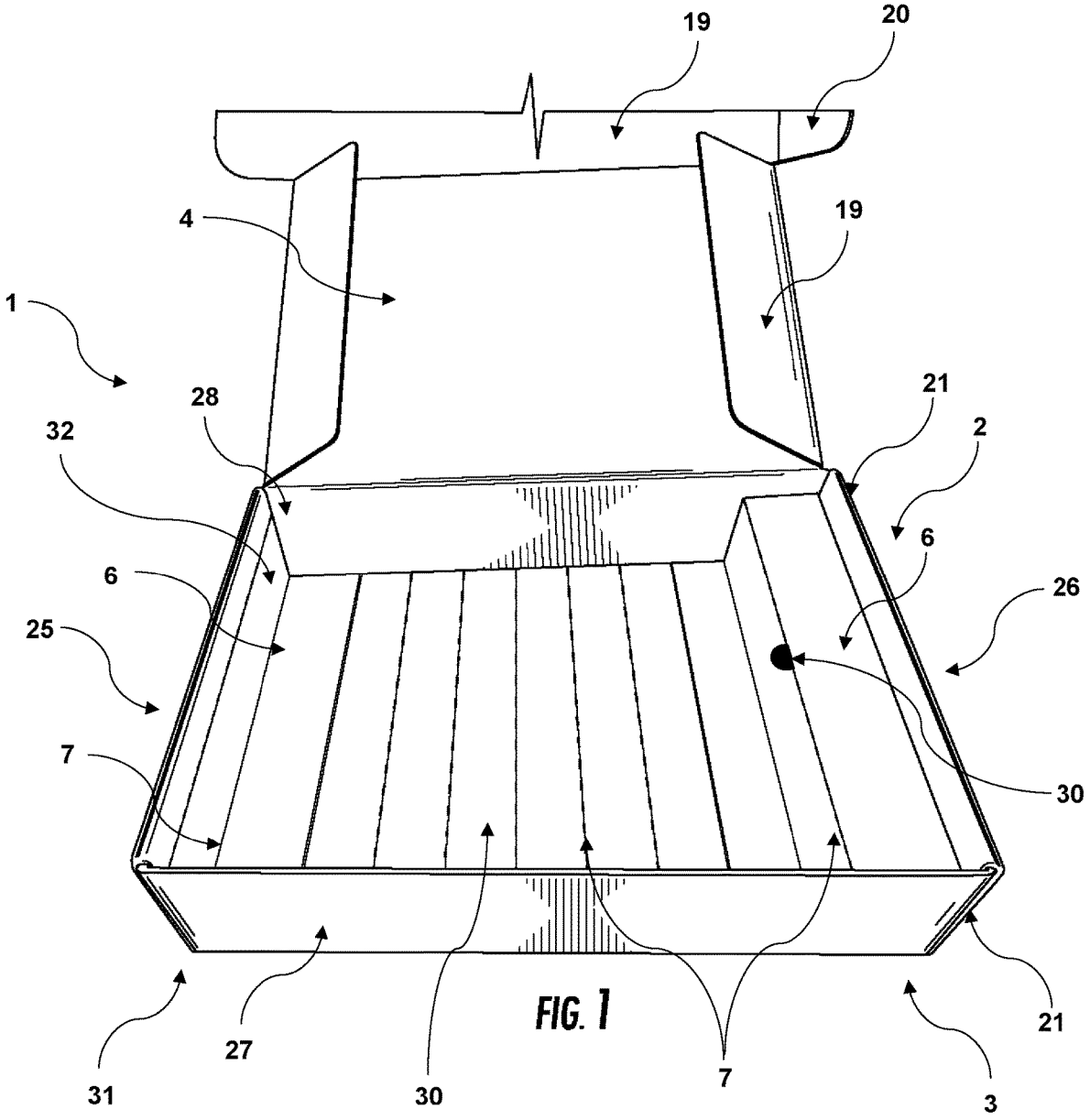
FIG. 1 shows an open perspective view of a shoe box according to one embodiment of the invention.

The present invention relates to a shoe box that accommodates different shoe sizes and styles. FIG. 1 shows an open perspective view of shoe box 1 which is a rectangular prism which comprises a length, defined as the longer sides of shoe box 1, a width, defined as the shorter sides of shoe box 1, and a height, defined as the dimension from the top (2) to the bottom (3) of shoe box 1. In embodiments with lid 4, top 2 is the face where lid 4 is placed and bottom 3 is the face opposite top 2. In embodiments without lid 4, top 2 is the face where the user accesses shoe 5, and bottom 3 is the face opposite top 2. In many embodiments the face of the rectangular prism which comprises top 2 is absent, leaving a space for the user to access the shoes. In many embodiments this space is covered by lid 4. In the rectangular prism embodiment shown in FIG. 1, shoe box 1 also contains a left (25), right (26), front (27), and back (28) face. In most embodiments shoe box 1 is comprised of base 31 which comprises the six faces described above. Inside of base 31 is inner area 32. In some embodiments shoe box 1 is a square, such that the length and width are generally the same size. In other embodiments, the three-dimensional shape of shoe box 1 is based on a two-dimensional shape selected from the group consisting of circle, triangle, square, rectangle, pentagon, hexagon, heptagon, octagon, nonagon, decagon, polygon, and combinations thereof.

In many embodiments shoe box 1 is equipped with protrusion 6 which protrudes into the inside of shoe box 1 and beneficially secures items inside of shoe box 1 which are smaller than the full area inside shoe box 1. In some embodiments, protrusion 6 extends along the entire length of shoe box 1 and in other embodiments protrusion 6 only extends along a portion of the length of shoe box 1. In some embodiment protrusion 6 extends along the entire width of shoe box 1 and in other embodiments protrusion 6 extends along a portion of the width of shoe box 1. In some embodiments protrusion 6 extends along the entire height of shoe box 1 and in other embodiment protrusion 6 only extends along a portion of the height of shoe box 1. Embodiments where protrusion 6 extends along the entire length, width, or height are useful as they give consistency along the entire dimension and embodiments where protrusion 6 only extends along a portion of the length, width, or height are useful as they give flexibility in terms of what areas need protrusion 6.

Figure 2:
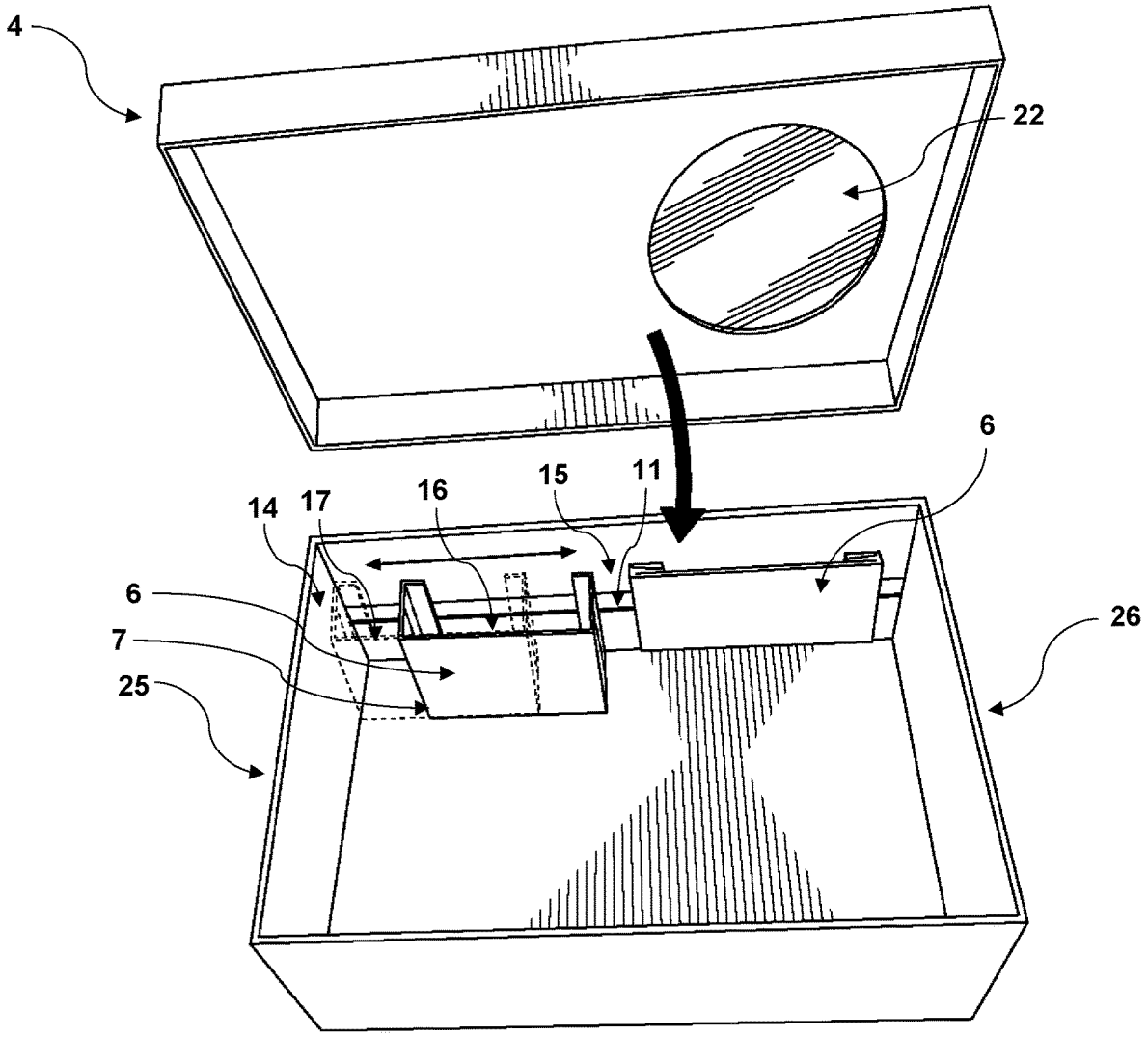
FIG. 2 shows an exploded perspective of another embodiment of the invention as the one shown in FIG. 1.

In some embodiments there is a single protrusion 6 and in other embodiments there are multiple protrusions 6. In some embodiments with multiple protrusions 6, all of the protrusions 6 are along the same face, as seen in FIG. 2 where all of the protrusions 6 are along back face 28 of shoe box 1, and in other embodiments with multiple protrusions 6, the protrusions are on different faces. Embodiments where the protrusions 6 are all on the same face are useful as they reduce the complexities in manufacturing and give consistency along the single face, and embodiments where the protrusions 6 are on different faces beneficially gives variability in what size and shaped objects can be secured by protrusion 6.

FIG. 2 shows an embodiment where there is a gap 15 between the different protrusions 6. The size and positioning of gap 15 is important a it allows shoe box 1 to fit a variety of shapes and sizes. In some embodiments the heel area of shoe 5 fits within gap 15, in other embodiments the toe of shoe 5 fits within gap 15, and in other embodiments protrusions which come off of shoe 5 fit within gap 15. All of these embodiments provide added security for shoe 5 and limit its movement along the dimensions of protrusion 6 and gap 15. For example, FIG. 1 shows an embodiment where protrusion 6 extends from right face 26 and limits the movement of shoe 5 along the length axis. However, if the toe area of shoe 5 is placed within a gap 15 on protrusion 6, now the movement of shoe 5 is limited in both the length and width axes, thus beneficially limiting movement in an additional axis.

The different location and number of protrusions 6 are important in the different embodiments. The position of protrusion 6 is important as it determines what sized and shaped objects can be placed within shoe box 1. A protrusion 6 on the length of shoe box 1 is useful when the items being placed within shoe box 1 have long and narrow regions, but with variable width, such as riding boots or other tall boots placed within shoe box 1 with the soles parallel to the width. A protrusion 6 on the width of shoe box 1 is useful when the length of the items being placed within shoe box 1 are variable, such as sneakers or dress shoes placed within shoe box 1 with the soles parallel to the length. A protrusion 6 on top 2 or bottom 3 of shoe box 1 are useful as they can be used as a divider within the middle of shoe box 1, or similarly give the benefits of a protrusion 6 on the length or width without the limitation of being exclusively on the side faces, as they can be placed anywhere along the top or bottom face.

Protrusions 6 on lid 4 have the added benefit that embodiments where lid 4 is removable can be switched out such that different lids 4 can have different protrusion 6 embodiments, making the base of shoe box 1 universal, with variable lids 4.

In some embodiments, protrusion 6 is permanently in the extended position. These embodiments give the benefit of stability of protrusion 6 as well as ease in manufacturing a generally immovable piece. In some of these embodiments protrusion 6 is solid and in others protrusion 6 is hollow. Solid protrusions 6 give greater stability to protrusion 6 while hollow protrusions 6 use less material and thus are cheaper to manufacture.

In some embodiments, protrusion 6 is able to be placed in an extended or contracted position. An example of such an embodiment can be seen in FIG. 1, where the protrusion 6 on the right side of shoe box 1 is extended and the protrusion on the left side of shoe box 1 is contracted. Such extending and contracting embodiments are useful as they allow protrusion 6 to extend or contract depending on the size of the shoe or other item within shoe box 1. In some embodiments with a protrusion 6, protrusion 6 is equipped with hole 30. Hole 30 gives the user a place to insert their finger which aides in the transition from contracted to extended position. In some embodiments only one hole 30 is provided and in others multiple holes 30 are provided.

The way in which protrusion 6 extends and contracts is different depending on the different embodiments. As seen in the embodiment shown in FIG. 1, in some embodiments protrusion 6 is an extra piece of material connected to two different faces. In some of these embodiments, protrusion 6 is placed in the contracted position when it lays flat against the two faces to which it is attached, as seen on the left side of FIG. 1. In order to extend these embodiments, fold line 7 is pulled outwards until protrusion 6 is placed in the extended position, as seen on the right side of FIG. 1.

FIG. 2 shows another embodiment of protrusion 6. In this embodiment, both sides of protrusion 6 are connected to the same face. In some of these embodiments, protrusion 6 is placed in the contracted position when it lays flat against the face to which it is attached, as seen on the right side of FIG. 2. The extended position of protrusion 6 is seen on the left side of FIG. 2. In some embodiments, protrusion 6 is extended by moving both sides of protrusion 6 towards one another, which moves fold lines 7 towards the inside of shoe box 1. In other embodiments, protrusion 6 is extended by moving one side of protrusion 6 towards the other.

In some embodiments discussed above there is only one fold line 7, and in other embodiments there are multiple fold lines 7. Embodiments with only one fold line are useful as they give greater stability to protrusion 6 as it only has one weak point where it can efficiently fold. In many embodiments where protrusion 6 is attached to two faces, the single fold line is placed at the corner between the two faces to which protrusion 6 are connected. Embodiments with multiple fold lines are useful as it gives protrusion 6 the ability to be multiple sizes depending on which fold line is used.

Figure 3A:
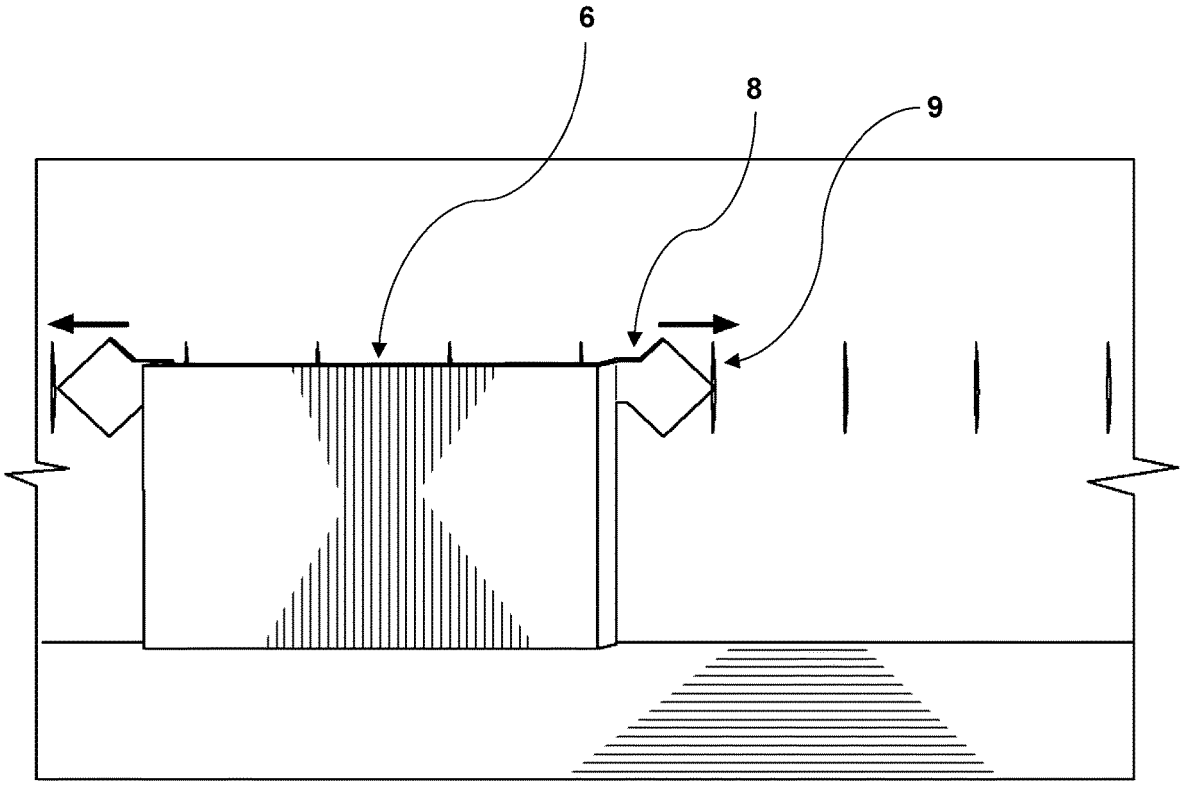
FIG. 3A shows a first embodiment of how the protrusion on the shoe box shown in FIG. 2 is attached to the shoe box.
Figure 3B:
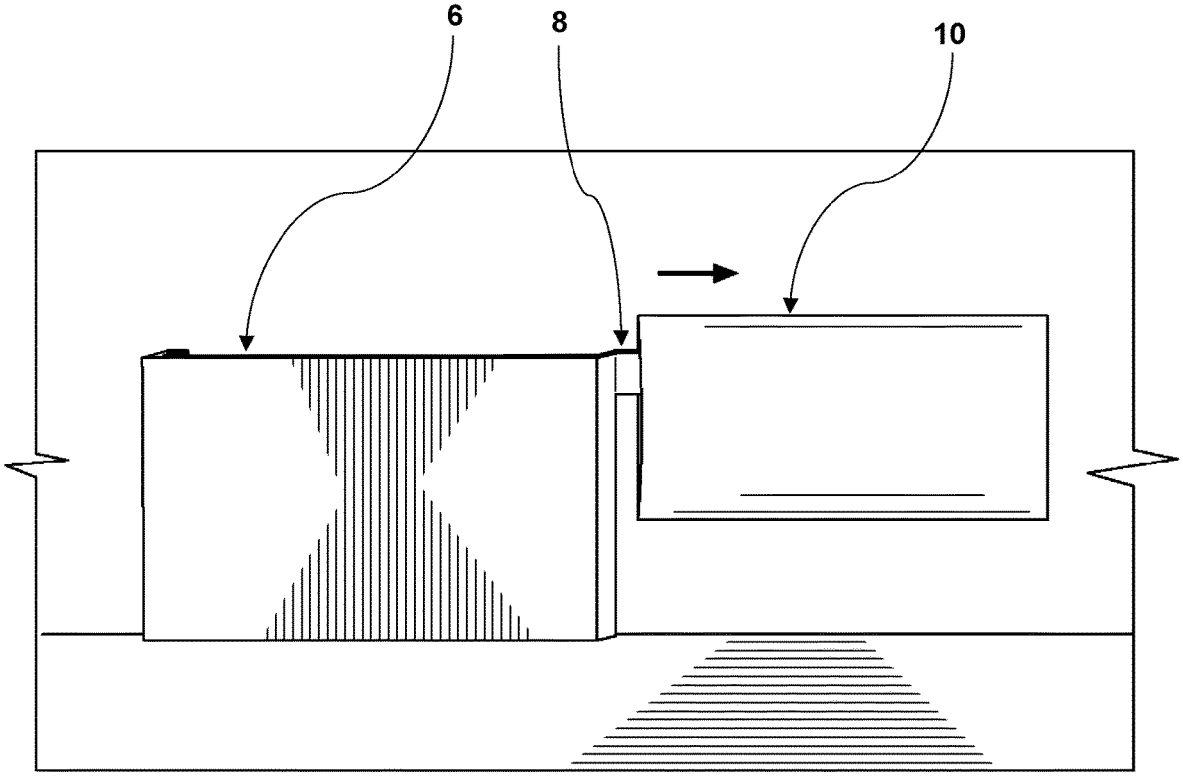
FIG. 3B shows a second embodiment of how the protrusion on the shoe box shown in FIG. 2 is attached to the shoe box.
Figure 3C:
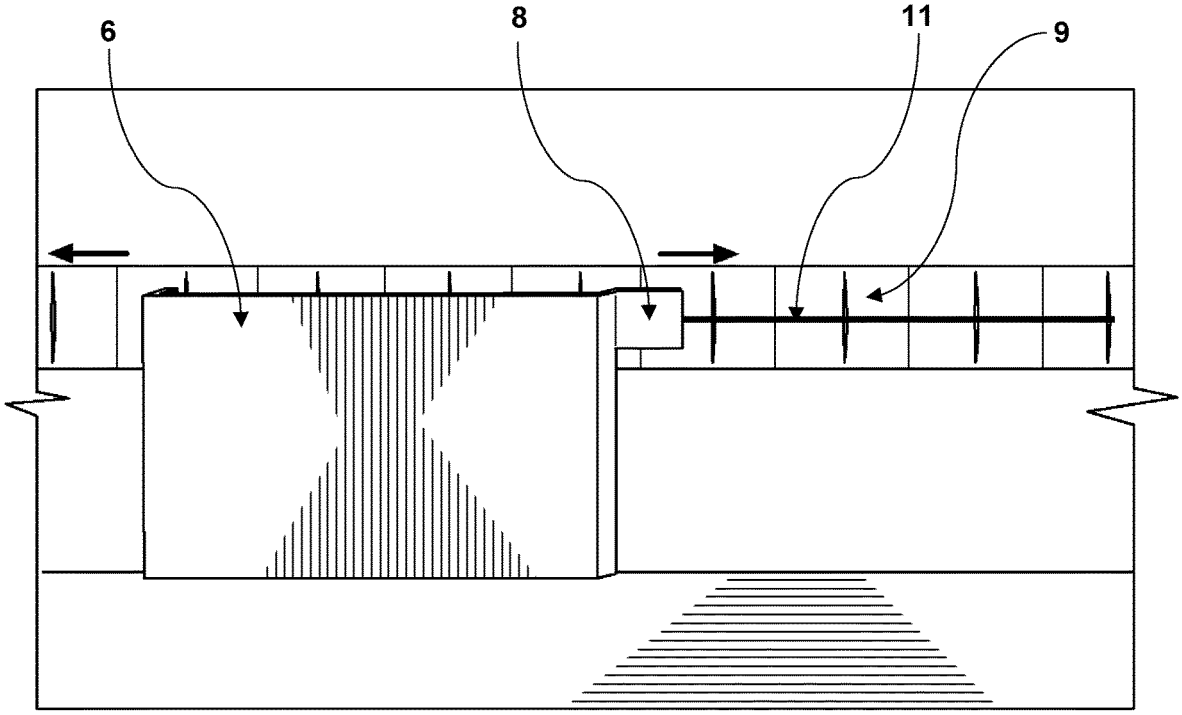
FIG. 3C shows a third embodiment of how the protrusion on the shoe box shown in FIG. 2 is attached to the shoe box.

In some of the embodiments discussed above, both sides of protrusion 6 are permanently attached to base 31 of shoe box 1, in other embodiments only one side of protrusion 6 is permanently attached to base 31 of shoe box 1, and in other embodiments neither side of protrusion 6 is permanently attached. In some embodiments where at least one side of protrusion 6 is not permanently attached, that side is equipped with tab 8 and the corresponding face of shoe box 1 is equipped with slit 9, as seen in FIG. 3A. In these embodiments, tab 8 fits within slit 9 to secure protrusion 6 in the extended or contracted position. In other embodiments, one or more sides of protrusion 6 are placed within pocket 10, as seen in FIG. 3B. In some embodiments with pocket 10, protrusion 6 is kept within pocket 10 by tab 8. In other embodiments, one or more sides of protrusion 6 are secured to track 11 by tab 8, as seen in FIG. 3C. Embodiments where protrusion 6 is permanently attached to shoe box 1 are useful as they give stability to protrusion 6 and do not require the added manufacturing steps such as tab 8 and slit 9. Embodiments where protrusion 6 is not permanently attached are useful as it gives added flexibility to protrusion 6, allows it to be secured to a larger variety of areas, and allows it to be re-used in other shoe boxes 1.

In some embodiments, protrusion 6 is able to be shifted laterally in track 11. This can be seen with the protrusion 6 in FIG. 2 which shifts from first protrusion 6 position 16 to second protrusion 6 position 17. These embodiments beneficially modify the size of gap 14 between from first protrusion 6 position 16 and left face 25 as well as the size of gap 15 between the protrusions 6. Adjusting the size of gaps 14 and 15 are useful as it allows protrusion 6 to accommodate different sized and shaped objects. For example, shifting protrusion 6 to fit in-between the heel and toe area of a high heeled shoe would beneficially secure the shoe within shoe box 1. However, this configuration would not be useful for sneakers or other shoes without a larger empty space between the heel and toe area.

In some embodiments where protrusion 6 is able to shift laterally in track 11, track 11 is further equipped with at least two slits 9 generally perpendicular to track 11, which helps secure the lateral movement of protrusion 6. In these embodiments, tab 8 on protrusion 6 slides along track 11 until hitting slit 9. Once tab 8 hits slit 9 it will fall into slit 9 which locks protrusion 6 at that position. In order to unlock protrusion 6, the user lifts tab 8 up from slit 9 and back into track 11, such that lateral movement can begin again. These embodiments beneficially allow protrusion 6 to stay in the desired position and enhances the benefits discussed above. In some embodiments multiple sets of slit 9 are placed along track 11 such that protrusion 6 has a variety of areas in which it can lock. In some embodiments these sets are evenly spaced and in others they are randomly spaced.

Figure 4:
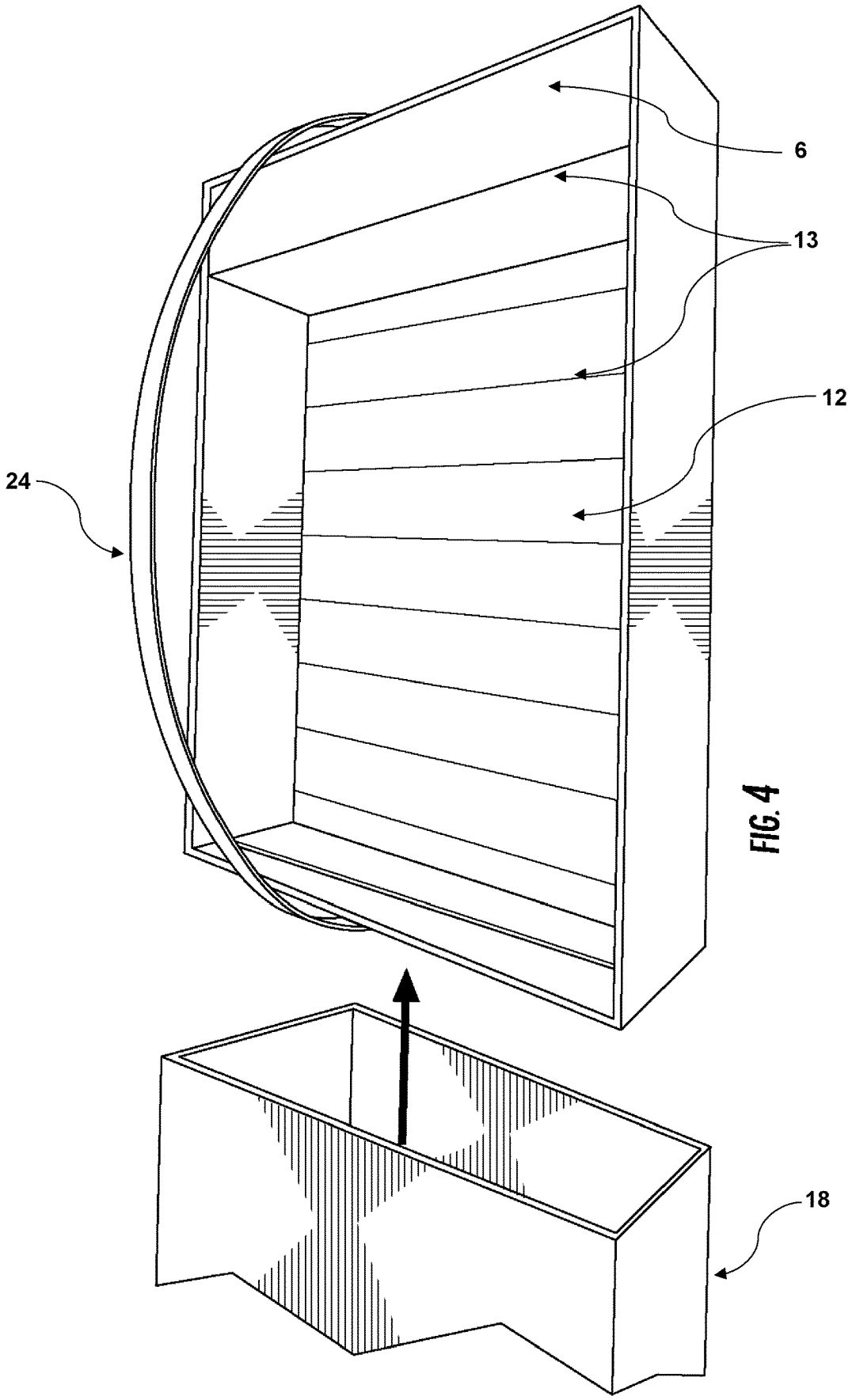
FIG. 4 shows an exploded perspective of another embodiment of the invention as the one shown in FIG. 1.

As seen in FIG. 4, in some embodiments inner area 32 is equipped with insert 12 to give inner area 32 a more aesthetically pleasing surface. In some embodiments insert 12 fits over protrusion 6. In some of these embodiments, insert 12 is equipped with fold line 13 which helps insert 12 to fold over protrusion 6. In some embodiments with fold line 13, there are multiple fold lines 13 so that insert 12 can fit over a variety of protrusion 6 sizes or styles. In other embodiments with fold line 13, only one fold line 13 is provided. In other embodiments, no fold line 13 is provided and insert 12 is manually folded to cover protrusion 6.

In some embodiments, insert 12 contains protrusion 6 on its underside and acts as a protrusion 6 itself. As with protrusion 6 above, in some embodiments there is one protrusion 6 on insert 12, in other embodiments there are more than one protrusions 6. In some embodiments protrusion 6 can be placed in an expanded or contracted position. Similarly, in some embodiment, protrusion 6 is permanently attached to insert 12 and in other embodiments protrusion 6 is not permanently attached. In these embodiments, protrusion 6 fixes to insert 12 as discussed above with regards to protrusion 6 attached to base 31.

In some embodiments insert 12 is blank, in other embodiments insert 12 is decorated with a design, and in other embodiments insert 12 is labeled with advertisement or branding.

In some embodiments, shoe box 1 is further equipped with lid 4 which covers top face 2. In these embodiments, shoe box 1 comprises base 31, comprising the top, bottom, left, right, front, and back faces, as well as lid 4 placed on top of top face 2. In some embodiments, such as the one shown in FIG. 1, lid 4 is permanently attached to shoe box 1 at at least one side. In other embodiments, such as the one shown in FIG. 2, lid 4 is not permanently attached to shoe box 1 and is removed to access shoe 5. Embodiments where lid 4 is permanently attached to shoe box 1 are useful as they prevent lid 4 from being lost or misplaced, and embodiments where lid 4 is not permanently attached to shoe box 1 are useful as they allow lid 4 to be used on different shoe boxes 1. Also, as discussed above, removable lid 4 with a protrusion 6 beneficially allow the use of a universal base of shoe box 1 with variable lids 4.

In some embodiments, lid 4 is equipped with flap 19 which helps secure lid 4 to shoe box 1. In some embodiments flap 19 is placed outside of shoe box 1, in other embodiments flap 19 is placed within shoe box 1, and in other embodiments flap 19 is received by pocket 21 in the sides of shoe box 1. In some embodiments, lid 4 is equipped with protrusion 20 which is received by pocket 21 on shoe box 1 and secures lid 4 to shoe box 1. In other embodiments, lid 4 is equipped with window 22 which beneficially shows the contents of shoe box 1 without the need to remove the lid.

In some embodiments, like the one shown in FIG. 4, shoe box 1 is covered by sleeve 18 which surrounds at least four faces of shoe box 1. In most embodiments, the four faces are top 2, bottom 3, front 27, and back 28. In other embodiments, a fifth side is protected, either left 25 or right 26. In these embodiments, sleeve 18 slides around shoe box 1 and beneficially gives an added layer of protection. In some embodiments, sleeve 18 replaces the need for lid 4 and in other embodiments sleeve 18 goes around lid 4.

In some embodiments, shoe box 1 is further equipped with handle 24. In some embodiments, handle 24 is attached to lid 4, in other embodiments, sleeve 18, and in other embodiments to the base 31. Embodiments where handle 24 is attached to lid 4 beneficially aid in the opening of lid 4, embodiments where handle 24 is attached to sleeve 18 beneficially aids in the opening of sleeve 18, as well as the carrying of shoe box 1 when sleeve 18 is surrounding shoe box 1, and embodiments where handle 24 is attached to base 31 beneficially aids in the transport of shoe box 1.

In some embodiments shoe box 1 is made of plastic, in others it is made of cardboard, in others it is made of paper, in others it is made of metal, and in others it is made of wood. The different materials are useful for different functions. For example, paper and cardboard boxes are useful for single-use boxes, due to their low cost of manufacture and ability for these materials to be recycled. Plastic, metal, or wood boxes are useful for higher end boxes which are either used multiple times or are designed to attract a different clientele then traditional cardboard boxes.

While the present invention has been particularly described, it is evident that many alternatives, modifications and variations will be apparent to those skilled in the art in light of the foregoing description. These descriptions and drawings are exemplary of specific embodiments only and are not intended to be limiting to the scope of the invention defined in the claims. It is therefore contemplated that the claims will embrace any such alternatives, modifications, and variations as falling within the true scope and spirit of the present invention.

What is claimed:

1. A shoe box comprising:

a base which further comprises an inner area;

a lid;

wherein said lid is attached to said base on at least one side;

at least two protrusions that protrude horizontally from same plane into said inner area;

wherein said one of at least two protrusions comprises a permanently extended position and is hollow;

wherein said at least two protrusions are attached to said shoe box;

a gap between said at least two protrusions;

wherein a toe area of a shoe fits within said gap;

a plurality of slits located on a back face of said inner area.

2. The shoe box according to claim 1, further comprising an internal length and wherein said one of the protrusions generally extends along said entire internal length.

3. The shoe box according to claim 1, wherein said lid further comprises a window.

4. The shoe box according to claim 1;

wherein said base further comprises a top face, a bottom face, a left face, a right face, a front face, and a back face;

wherein said lid further comprises a top face and a bottom face;

wherein said protrusion protrudes from the face selected from the group consisting of said bottom base face, said left base face, said right base face, said front base face, said back base face, said bottom lid face, and combinations thereof.

5. The shoe box according to claim 1;

wherein said base further comprises a top face, a bottom face, a left face, a right face, a front face, and a back face;

wherein said protrusion is attached to two of said faces.

6. A shoe box comprising:

a base which further comprises an inner area and at least one side;

a lid;

wherein said lid is permanently attached to said base at said at least one side;

at least three protrusions which protrude in the same direction into said inner area from the same plane;

wherein at least one side of said at least three protrusions are removably attachable;

wherein said at least three protrusions have a plurality of wall positions;

wherein each of said at least three protrusions comprises an extended and a contracted position;

wherein each of said at least three protrusions can engage in said extended position and said contracted position from a singular wall position.

7. The shoe box according to claim 6, wherein said base further comprises at least one slit and wherein at least one of said at least three protrusions further comprises a tab which mates with said at least one slit and attaches said at least one of said at least three protrusions to said base.

8. The shoe box according to claim 6, wherein said base further comprises a track and wherein at least one of said at least three protrusions further comprises a tab which mates with said track and attaches said at least one of said at least three protrusions to said base.

9. The shoe box according to claim 6, wherein said lid further comprises a window.

10. The shoe box according to claim 2, wherein said one of the protrusions extends along a portion of the length of said internal length.

11. The shoe box according to claim 1, further comprising an internal height and wherein said one of the protrusions generally extends along said entire internal height.

12. The shoe box according to claim 11, wherein said one of the protrusions extends along a portion of the height of said internal height.

13. The shoe box according to claim 6, wherein at least one of said at least three protrusions is permanently attached to said inner area.

14. The shoe box according to claim 6, further comprising a gap between at least two of said at least three protrusions wherein said gap can vary in size and position.

* * * * *